United States Patent [19]

Buscher et al.

[11] Patent Number: 4,609,244

[45] Date of Patent: Sep. 2, 1986

[54] ELECTRICAL CONNECTOR

[75] Inventors: John H. Buscher, East Amherst; Michael E. Hoffman, Lockport, both of N.Y.

[73] Assignee: Eastman Machine Company, Buffalo, N.Y.

[21] Appl. No.: 430,757

[22] Filed: Sep. 30, 1982

[51] Int. Cl.[4] ..... H01R 27/00

[52] U.S. Cl. ..... 339/32 M; 339/176 M; 339/196 M; 339/119 R

[58] Field of Search ..... 339/32 R, 210 R, 210 M, 339/32 M, 186 R, 176 M, 186 M, 196 R, 196 A, 196 M, 91 R, 14 R, 14 P, 119 R

[56] References Cited

U.S. PATENT DOCUMENTS

| | | | |
|---|---|---|---|
| 1,647,697 | 11/1927 | Hessel | 339/196 R |
| 1,917,009 | 7/1933 | Betts et al. | 339/196 M |
| 2,641,746 | 6/1953 | Keller | 339/210 R |
| 2,930,019 | 3/1960 | Hubbell | 339/31 |
| 3,088,091 | 4/1963 | Linn | 339/210 M |
| 3,134,631 | 5/1964 | Whalen | 339/31 R |
| 3,377,613 | 4/1968 | Archer | 339/191 R |
| 3,550,067 | 12/1970 | Hansen | 339/91 R |
| 3,838,385 | 9/1974 | Bloomingdale | 339/196 A |
| 4,350,403 | 9/1982 | Seytre et al. | 339/91 R |
| 4,415,214 | 11/1983 | Obst | 339/91 R |

FOREIGN PATENT DOCUMENTS

| | | | |
|---|---|---|---|
| 0722644 | 1/1955 | United Kingdom | 339/31 M |
| 0908759 | 10/1962 | United Kingdom | 339/196 R |
| 1388868 | 3/1975 | United Kingdom | 339/31 M |
| 2097202 | 10/1982 | United Kingdom | 339/31 R |

*Primary Examiner*—Gil Weidenfeld
*Assistant Examiner*—Thomas M. Kline
*Attorney, Agent, or Firm*—Christel, Bean & Linihan

[57] ABSTRACT

An electrical connector for supplying electrical power to a machine at particular voltage and phase magnitudes selected, the connector having one part adapted to be mechanically and electrically connected to the machine and another part adapted to be electrically connected to a conductor providing the electrical power to be supplied. The connector comprises a plurality of pins on one of the connector parts and a corresponding plurality of mating slots on the other of the connector parts adapted to receive the pins when the connector parts are connected together. One of the pins and the corresponding one of the mating slots serve to complete a electrical ground circuit and have a fixed orientation independent of the selected voltage and phase magnitude for the particular connector. The remaining ones of the pins and slots are of a total number and have respective orientations unique to the particular voltage and phase magnitude selected for the connector, and the total number and orientations of the remaining pins and slots are fixed and non-changeable. The total number and orientations of the remaining ones of the pins and slots also are selected to prevent connection between either of the connector parts and a part of another connector of the same type as the connector but operative with different selected voltage and phase magnitudes.

30 Claims, 14 Drawing Figures

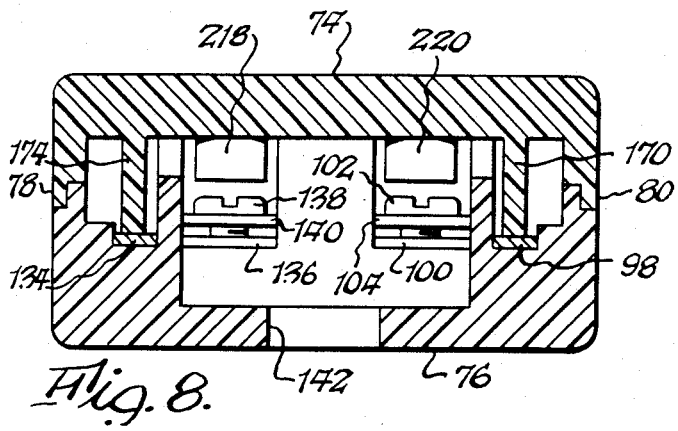
Fig. 8.
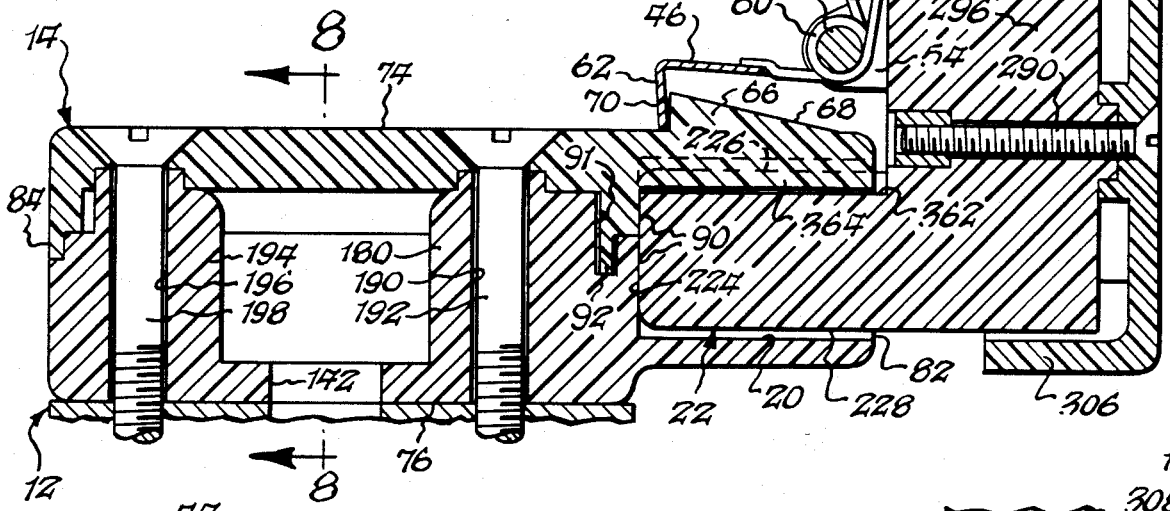
Fig. 6.
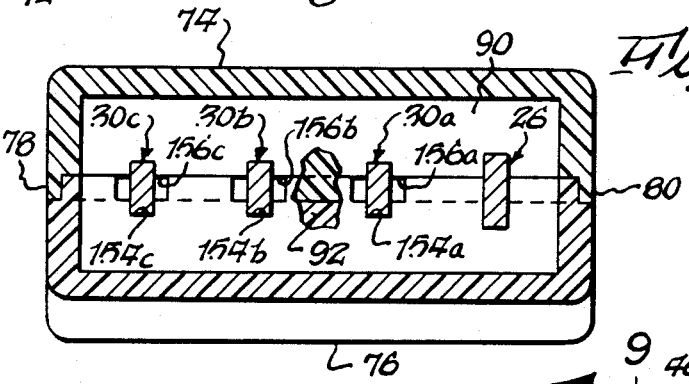
Fig. 9.
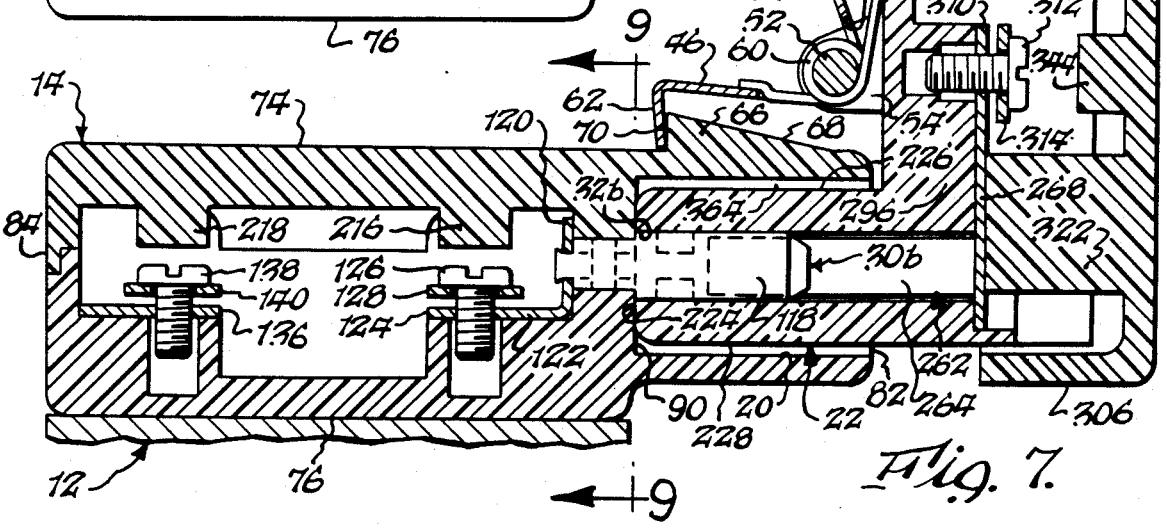
Fig. 7.
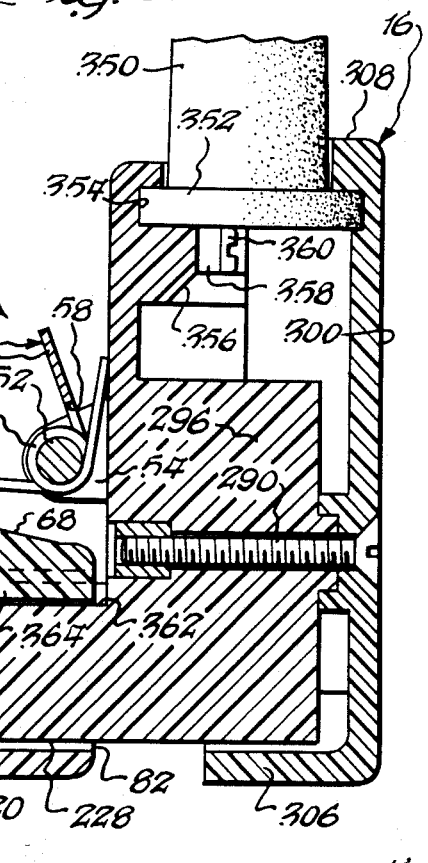

Fig. 14.
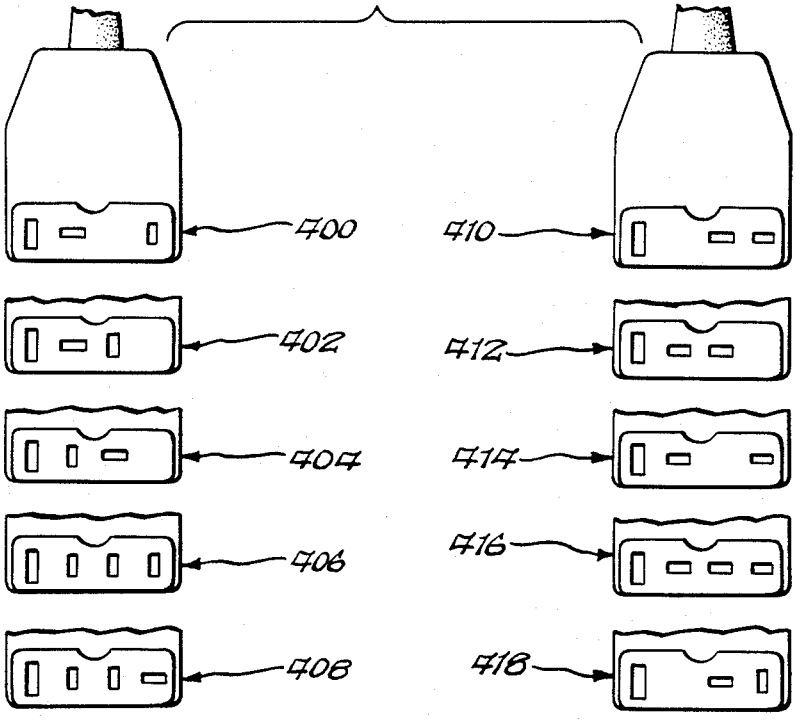
Fig. 12.
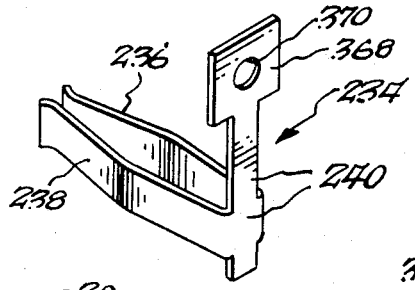
Fig. 13.
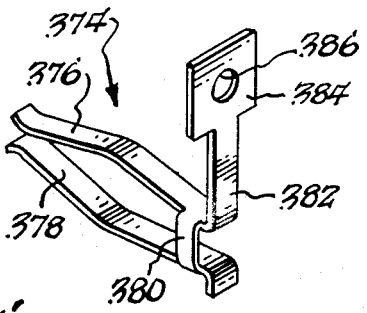
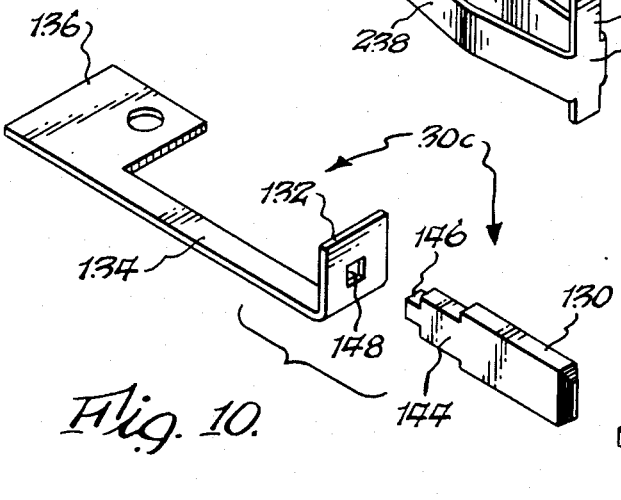
Fig. 10.
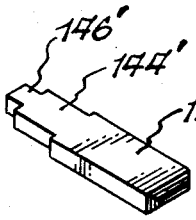
Fig. 11.

ELECTRICAL CONNECTOR

BACKGROUND OF THE INVENTION

This invention relates to the electrical connector art, and more particularly to a new and improved electrical connector for use in accommodating different voltage and phase situations in supplying power to machines.

One area of use of the present invention is in supplying electrical power to machines which are manipulated by industrial personnel, although the principles of the present invention can be variously applied. An example of the foregoing is motor driven machines for cutting or punching cloth or like material which are moved manually by an operator over and along a workpiece being cut or punched according to a desired pattern or configuration. Such electrically operated machines have various operating requirements including different voltage magnitudes and/or phase magnitudes depending upon the particular machine and also the environment where it is used. Thus, different machines may require different voltage and phase magnitudes, but the same machine may require different voltage and phase magnitudes in different countries.

Accordingly, it would be highly desirable to provide an electrical connector as a member of a series or family of electrical connectors to accommodate such number of voltage magnitude and/or phase situations for operating such machinery but wherein among the family or series of connectors any given connector part will mate or fit with only one other connector part. In other words, it is required that a part of a connector designed for a particular voltage and/or phase may not be physically or mechanically connected to a part of another connector designed for a different voltage and/or phase. The foregoing must be provided in a connector structure which is safe and satisfies appropriate electrical codes, and it would be advantageous to provide the foregoing in a structure which is convenient and economical to manufacture.

SUMMARY OF THE INVENTION

It is, therefore, a primary object of this invention to provide a new and improved electrical connector for use in accommodating different voltage and phase situations in supplying power to machines.

It is a more particular object of this invention to provide such a connector as a member of a series or family of connectors to accommodate a number of voltage and phase magnitudes for operating machinery but wherein among the family or series of connectors any given connector part will mate or fit with only one other connector part.

It is a further object of this invention to provide such a connector having a structure which is safe and satisfies applicable electrical codes.

It is a further object of this invention to provide such a connector which is convenient and economical to manufacture.

It is a further object of this invention to provide an improved method of making a part of such connector.

The present invention provides an electrical connector for supplying electrical power to a machine at particular voltage and phase magnitudes selected, the connector having one part adapted to be mechanically and electrically connected to the machine and another part adapted to be electrically connected to a conductor providing the electrical power to be supplied. The connector comprises a plurality of pins on one of the connector parts and a corresponding plurality of mating slots on the other of the connector parts adapted to receive the pins when the connector parts are connected together. One of the pins and the corresponding one of the mating slots serve as means for completing an electrical ground circuit and have a fixed orientation independent of the selected voltage and phase magnitude for the particular connector. The remaining ones of the pins and slots are of a total number and have respective orientations unique to the particular voltage and phase magnitude selected for the connector, and the total number and orientations of the remaining pins and slots are fixed and non-changeable. The total number and orientations of the remaining ones of the pins and slots also are selected to prevent connection between either of the connector parts and a part of another connector of the same type as the connector but operative with different selected voltage and phase magnitudes. One of the connector parts is provided with a recess, the other part is provided with an extension which fits snugly and firmly within the recess when the connector parts are connected together with the pins received in the slots, and there is provided manually operable means for enhancing or locking the connection between the parts. In a method for forming the connector part having the slots, a hollow body is formed to have an end face and to include the one slot in the end face, and subsequently the remaining slots are provided such as by stamping in the end face spaced from the one slot and being of a number and having orientations selected according to the voltage and phase magnitudes for the particular connector.

The foregoing and additional advantages and characterizing features of the present invention will become apparent upon a reading of the ensuing detailed description together with the included drawing wherein:

BRIEF DESCRIPTION OF THE DRAWING FIGURES

FIG. 6 is a sectional view taken about on lines 6—6 in FIG. 2;

FIG. 7 is a sectional view taken about on lines 7—7 in FIG. 5;

FIG. 8 is a sectional view taken about on lines 8—8 in FIG. 6;

FIG. 9 is a sectional view taken about on lines 9—9 in FIG. 7;

FIG. 10 is an exploded perspective view illustrating assembly of a pin for the connector receptacle with the blade portion in one orientation;

FIG. 11 illustrates the blade portion of the pin of FIG. 10 in a different orientation for eventual assembly;

FIG. 12 is a perspective view of one form of a contact in the connector plug;

FIG. 13 is a perspective view of another form of contact in the connector plug; and FIG. 14 is a diagramatic view illustrating various arrangements of slots in the connector plug.

DETAILED DESCRIPTION OF THE ILLUSTRATED EMBODIMENT

Figure 1:
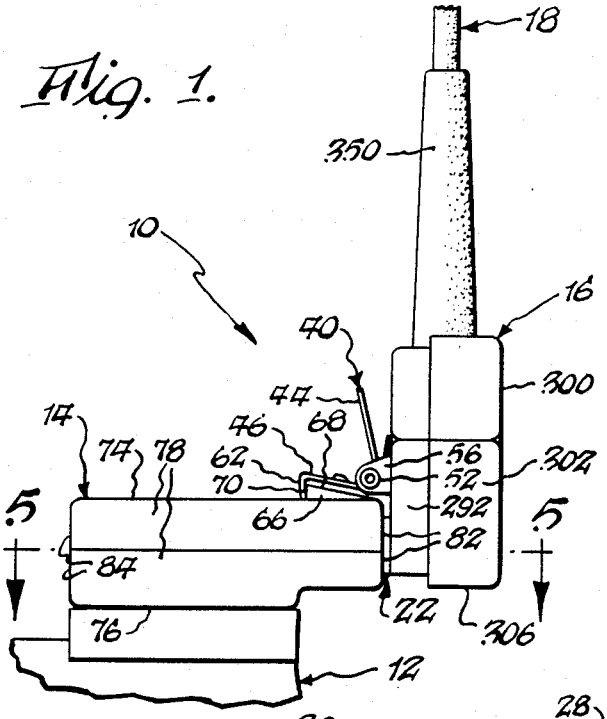
FIG. 1 is a fragmentary side elevational view showing the electrical connector of the present invention with one part thereof mounted on a motor driven machine.
Figure 2:
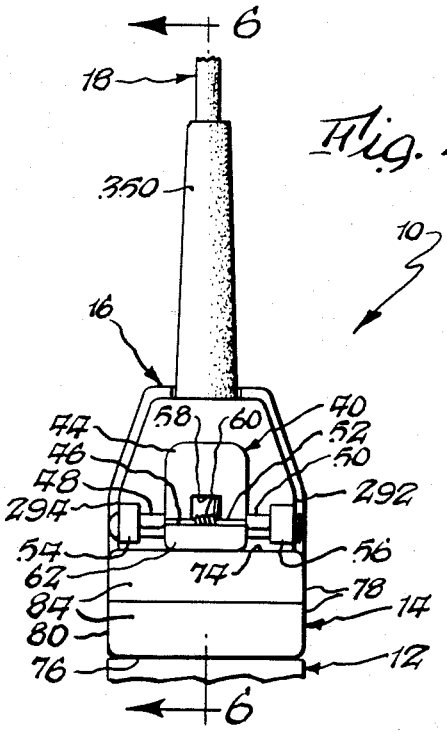
FIG. 2 is a fragmentary end elevational view of the connector of FIG. 1.
Figure 3:
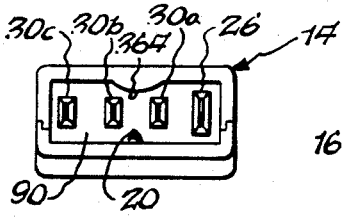
FIG. 3 is a fragmentary end elevational view showing a recess of the receptacle part of the connector of FIGS. 1 and 2.
Figure 4:
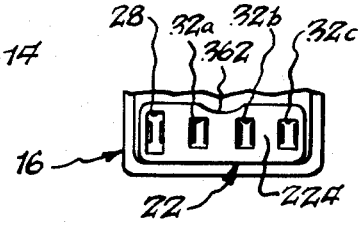
FIG. 4 is a fragmentary end elevational view showing an extension of the plug part of the connector of FIGS. 1 and 2.

Referring now to FIGS. 1–4, an electrical connector generally designated 10 is provided for supplying electrical power to a machine, a portion of which is generally designated 12, at particular voltage and phase magnitudes selected. Connector 10 has one part generally designated 14 adapted to be mechanically and electrically connected to machine 12, and another part generally designated 16 adapted to be electrically connected to a conductor 18 providing the electrical power to be supplied. In the connector shown, part 14 may be viewed as the connector receptacle, part 16 viewed as the connector plug. Each of the connector parts 14 and 16 comprises a body having an end, and the end of one of the parts, in the device shown the receptacle part 14, is formed to include a recess 20, and the end of the other part, i.e. the plug 16, is formed to include an extension 22 to fit snugly mechanically within the recess 20 of part 14 when the connector parts are connected together. Conductor 18 is connected to a conventional source or supply of line voltage appropriate for the machine being operated.

Machine 12 is representative of various types of motor driven machinery, and one example is a machine for cutting or punching cloth or like material which machine is moved manually by an operator over and along a workpiece being cut or punched according to a desired pattern or configuration. For a more detailed descrpition of such machines, reference may be made to U.S. Pat. Nos. 4,029,372 issued June 14, 1977 and 4,306,356 issued Dec. 22, 1981, the disclosures of both of which patents are incorporated by reference. Such electrically operated machines for industiral use have various operating requirements which include a number of different voltage magnitudes and/or phase magnitudes depending upon the particular machine and also the environment where it is used. For example, different machines may have different voltage and phase magnitudes, but the same machine may require different voltage and phase magnitudes in different countries. Accordingly, it would be highly desirable to provide a series or family of electrical connectors to accomodate such number of voltage magnitude and/or phase situations for operating such machinery but wherein among the family or series of connectors any given connector part will mate or fit with only one other connector part. In other words, it is required that the plug of a connector designed for a particular voltage and/or phase may nated 28 serve as means for completing an electrical ground circuit when the connector parts are connected together. The pin 26 and corresponding slot 28 both have a fixed orientation independent of the selected voltage and phase magnitude for the particular connector. In other words, within a group or family of various electrical connectors according to the present invention for different voltage and/or phase magnitude situations, the location and orientation of the pin 26 and mating slot 28 will always be the same.

In the illustrative connector shown there is a total of three remaining or additional pins designated **30*a*,30*b* and 30*c* in the part 14, and a corresponding number of mating slots 32*a*,32*b* and 32*c* in the part 16. In accordance with the present invention the remaining ones of the pins 30 and slots 32 are of a total number and have respective orientations both of which are unique to the particular voltage magnitude and to the particular phase magnitude selected for a particular connector. This total number of pins and slots and the respective orientations is fixed and nonchangeable in a particular connector. In addition, the total number and the particular orientations of the remaining ones of the pins 30 and slots 32 also are selected to prevent connection between either of the connector parts 14,16 and a part of another connector of the same type as connector 10** but operative with different selected voltage and phase magnitudes.

The pins 26,30 are arranged along a row in the connector part 14, and the slots 28,32 are arranged along a row in the other part 16. The one pin 26 and mating slot 28 are disposed in one plane, which in the connector shown is perpendicular to the direction of the row, and the remaining pins 30 and mating slots 32 are disposed in planes parallel to or perpendicular to the first plane as determined by a relationship to the particular voltage and phase magnitudes selected for the particular connector. In the device shown, the additional pins 30 are all in planes parallel to the plane of pin 26 and, similarly, the slots 32 all are in planes parallel to the plane of slot 28. However, for different voltage and/or phase magnitude situations, one or more of the pins 30 will be disposed perpendicular to the plane of pin 26 and the corresponding slot or slots likewise will be disposed perpendicular to slot 28. Also, while three remaining or additional pins 30 and mating slots 32 are shown in the illustrative connector, this number could be fewer or greater than the number shown depending upon the voltage and/or phase conditions. Generally, at least two of the additional pins 30 and corresponding slots 32 will be provided on a connector.

Recess 20 in receptacle 14 and extension 22 on plug 16 are shaped and sized to provide a snug and firm mechanical fit between the parts 14,16 when they are connected together with the pins of part 14 received in the slots of part 16. The mechanical fit can be augbetween. Leg 44 extends in a direction along the outer surface of plug 16, and leg 46 extends along extension 22. Leg 44 is of slightly smaller width than leg 46, and a pair of curved arms 48,50 are formed adjacent the outer opposite edges where legs 44 and 46 meet. The arms 48,50 are shaped to provide a pivotal connection of the structure to a pin 52 fixed at opposite ends in extensions 54,56 fixed to or integrally formed with the outer surface of plug 16. The central region adjacent the junction of legs 44,46 is provided with an opening 58 to accomodate biasing means in the form of a spring 60 coiled on pin 52 having one end engaging leg 46 and the other end engaging the outer surface of plug 16. Leg 46 terminates at the outer end in a short tab formation 62 disposed at substantially a right angle to the body of leg 46.

The connecting means 40 further comprises a second part fixed to receptacle 14 and having a formation thereon adapted to be engaged by the formation on the first part of the connecting means. The second part comprises a body 66 formed integrally with receptacle 14 on an outer surface thereof which is adjacent recess 20 and which extends generally parallel to the recess. Body 66 is of increasing thickness in a direction generally parallel to recess 20 and defines an inclined or ramp-like surface 68 which terminates in an edge 70 disposed in a plane perpendicular to the outer surface of receptacle 14. The distance between edge 70 and the end of receptacle 14 including recess 20 is substantially equal to the distance between end tab 62 and the surface of plug 16 from which extension 22 projects.

When it is desired to manually connect the connector parts 14,16 together, the operator grasps plug 16 by hand and moves it and the conductor 18 extending therefrom into position adjacent receptacle 14 which is mounted on machine 12. The operator orients plug 16 with extension 22 in registry or alignment with recess 20 on receptacle 14. Then the operator uses a finger of the hand holding plug 16 to move leg 44 toward the surface of plug 16 thereby pivoting the part about pin 52 against the force of biasing spring 60. The operator holds leg 44 in that position and then urges extension 22 into recess 20 as far at it will go thereby causing the pins of receptacle 14 to be received in the slots of plug 16. With leg 44 held in the above-mentioned position, end tab 62 clears body 66 as plug 16 is moved into the receptacle 14. Then, when the fit is made, arm 44 is released and spring 60 moves the part into a position where end tab 62 of arm 46 engages surface 70 of body 66 on receptacle 14 thereby augmenting the mechanical connections of the parts 14,16. This is the condition illustrated in FIGS. 1, 2, 6 and 7.

When it is desired to disconnect the parts, plug 16 is grasped by hand, arm 44 moved by the finger toward plug 16 to free tab 62 from surface 70 and body 66 and then plug 16 merely is pulled away from receptacle 14 removing extension 22 from recess 20. The foregoing arrangement thus provides an effective mechanical connection between parts 14,16 which is easy for operating personnel to manipulate. The pivotal or movable part of the connecting means is provided on the plug 16 of the connector for the reason that plug 16 is manipulated by hand, and the foregoing operation can be performed by an operator using only one hand if desired and if machine 12 and its receptacle 14 are substantially immovably positioned or held. Also, the connecting means serves as a releasable locking means between parts 14,16 in co-operation with the snug mechanical fit between extension 22 and recess 20.

Referring now to FIGS. 5–9, receptacle 14 is in the form of a hollow body of generally rectangular shape and is of plastic or like insulative material. The body includes a top side wall 74 and a bottom side wall 76 as viewed in the drawing, sides 78 and 80 generally perpendicular to the walls 74,76, one end 82 which contains the recess 20 and an opposite end 84. In the connector shown, the body comprises two half sections or parts which are snap-fitted together. The plane of separation of the two parts is substantially parallel to the surfaces of the top side wall 74 and bottom side wall 76. The recess 20 is defined by an opening in the end 82, by inwardly extending inner wall surface portions of the top side wall 74 and bottom side wall 76, and by the included portions of inner wall surface portions of the sides 78 and 80. Recess 20 terminates in an end wall 90 spaced inwardly from the end 82 and disposed substantially perpendicular to the planes of the top side wall 74 and bottom side wall 76. End wall 90 is defined by complementary sections associated with the two body parts. There is a wall 91 spaced inwardly a short distance from and parallel to wall 90 defining a space therebetween into which a tongue-like wall portion 92 extending from one body part is received.

End wall 90 and the associated wall structures 91,92 are provided with a plurality of openings through which the pins 26 and 30 extend. The openings are arranged in spaced relation along a row extending in a direction generally parallel to the planes of the top and bottom side walls 74, and 76, respectively, as viewed for example FIG. 9. Each of the pins 26 and 30 has a portion extending in a direction from the end wall 90 into the interior of the receptacle hollow body, and each of the pins has a portion extending from the end wall 90 outwardly, in an opposite direction, and the outwardly extending pin portions are located in the recess 20. In addition, the outwardly extending portion of each pin makes electrical connection to a corresponding contact in the other connector part 16 when the parts 14,16 are connected together, and the inwardly extending portion of each pin is connected electrically to a conductor leading from machine 12 into the body of receptacle 14.

Figure 5:
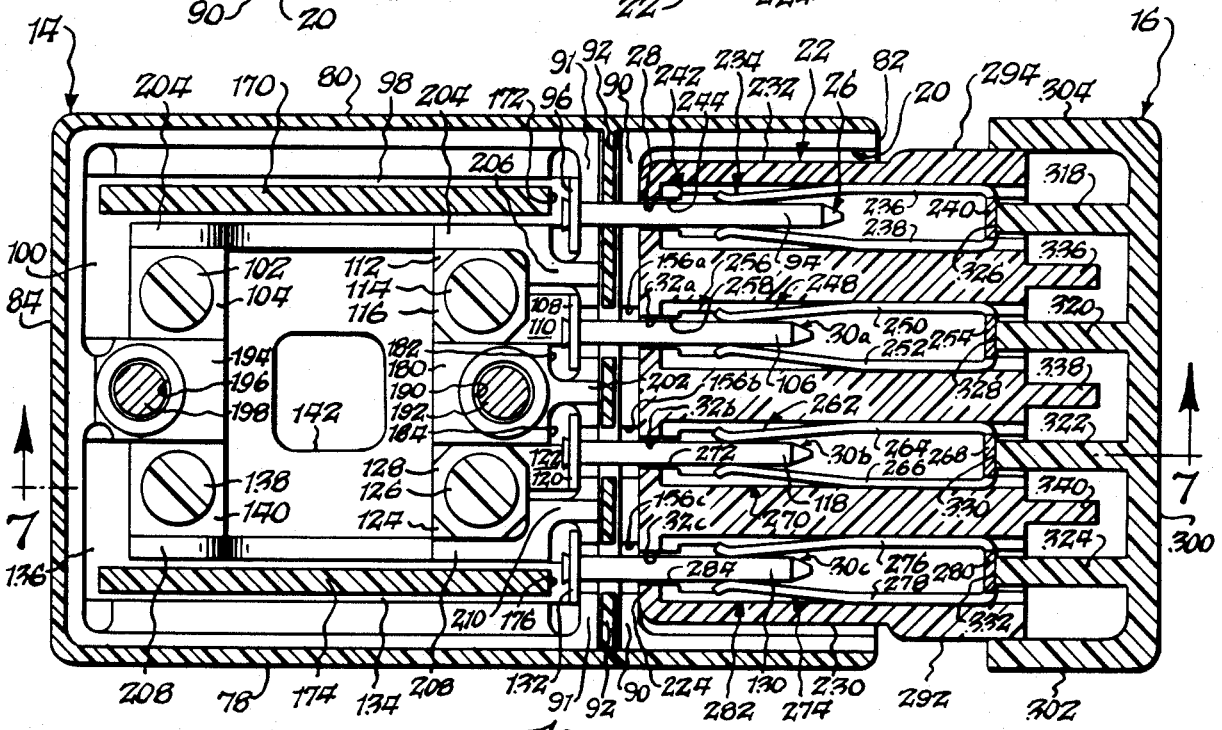
FIG. 5 is a sectional view taken about on lines 5—5 in FIG. 1.

In accordance with the present invention, each of the inwardly extending pin portions cooperates with structure within the body of receptacle 14 and each has a configuration different from that of the other inwardly extending pin portions so as to prevent the pins from being interchanged in the same connector. In particular, as shown in FIG. 5, pin 26 has an outwardly extending blade portion 94 and an inwardly extending portion including an end tab 96 fixed to the end of blade portion 94, an elongated body section 98 extending at about a right angle to tab 96 and along within the hollow interior of receptacle 14 in a direction substantially parallel to the receptacle side 80, and a terminal formation 100 at the end thereof located near the end 84 of the receptacle. The terminal formation 100 cooperates with a screw 102 and terminal washer 104 for making electrical connection to a lead of a conductor extending into receptacle 14 from machine 12. Pin **30*a* includes an outwardly extending blade portion 106, and the inwardly extending portion has a tab 108 fixed to the end of blade 106, a relatively short body 110 disposed at about a right angle to tab 108, and a terminal formation 112 which cooperates with a screw 114 and terminal washer 116 for making electrical connection to another lead of the previously mentioned conductor. The terminal formation 112 thus is relatively close to wall 90. Similarly, pin 30***b* has an outwardly extending blade portion 118 and an inner portion including a tab 120, a relatively short body 122 disposed at about a right angle thereto, and a terminal formation 124 which cooperates with a screw 126 and a terminal washer 128 for making an electrical connection to a lead of the aforementioned conductor. The terminal formation 124 likewise is relatively close to wall 90. Pin 30*c* has an outwardly extending blade portion 130 and an inner portion including a tab 132, an elongated body section 134 extending at a right angle to tab 132 and in a direction generally parallel to the side 78 and terminating adjacent the end 84 of the receptacle in a terminal formation 136. Terminal formation 136 cooperates with a screw 138 and terminal washer 140 for making electrical connection to a lead of the aforementioned conductor.

With respect to the pins 26 and 30*c*, the disposition of the tabs 96 and 132 at right angles to the body sections 98 and 134, respectively, together with the fact that the terminal formations 100 and 136 are in opposed relation, i.e. both extending inwardly toward each other as viewed in FIG. 5, prevents these pin portions from being physically interchangeable within the same connector. Likewise, with respect to pins 38*a* and 30*b*, the disposition of the tabs 108 and 120 at right angles to the respective body sections 110 and 122 together with the fact that the terminal formations 112 and 124 extend in opposite directions, i.e. away from each other and toward the corresponding sides 80,78 prevents these pins from being physically interchangeable within the same connector. Along with the foregoing differences in configuration, pins 26 and 30*c* are larger than pins 30*a*,30*b*. Also, as illustrated in FIG. 5, the blade portion 94 of pin 26 is longer than the blade portions of the other pins 30 with the result that when the connector parts 14,16 are connected together the electrical ground circuit is completed an instant before the other circuits associated with pins 30 in a manner which will be described. In addition, there is provided an opening 142 in the receptacle body, in particular generally centrally of the bottom side wall 76, through which a conductor extends from machine 12 containing the various leads which are connected to the afore-mentioned terminals.

FIG. 10 illustrates in further detail one of the pins and the manner of assembly thereof, for example the pin 30*c*. In the connector shown, the blade portion 130 of the pin is of constant thickness. In addition, it has the same width along a major portion of the length extending along from the outer end toward the opposite end and it has a portion 144 of intermediate width near the opposite end where it terminates in an end formation 146 of smaller width which defines a projection which is fitted into an opening 148 in the tab 132 as shown in FIG. 10. The two parts are permanently secured together in a suitable manner, such as by welding. Such permanent securement prevents the user from being able to change pin orientation or number on a particular connector and also provides added safety. The portion 144 of intermediate width is received in an opening in wall 90 in a manner which will be described. FIG. 11 shows a blade 130' identical to blade 130 and in a position rotated 90° relative to the blade 130 in FIG. 10 to illustrate the other orientation of the pins and the manner of assembly. The projection 146' on the end of the blade 130' is fitted into and secured into the tab opening 148 in a similar manner. Thus, the structure and manner of assembly of the blade and inner portion of each of the pins allows convenience and ease in manufacture while providing the capability of having the pins assembled in either of the two selected orientations depending upon the specific voltage magnitude and phase magnitude corresponding to the particular connector being manufactured.

As previously described, each of the pins 26,30 extends through an opening in the wall 90, and in accordance with the present invention each of the openings in wall 90 for the pins 30 is of a size and of a shape to accommodate different selected orientations of the pins. In particular, each of the openings has first and second portions disposed at angles to each other corresponding to the two selected orientations of the pins according to the particular voltage and phase magnitude conditions as previously described. Thus, as illustrated in FIGS. 5, 7 and 9, for blade 106 of pin 30*a*, the opening has a first portion 154*a* which is disposed perpendicular to the planes of the receptacle top and bottom side walls 74,76, respectively. The length of portion 154*a* is substantially equal to the width of the intermediate part of blade 106, and the width of opening portion 154*a* is substantially equal to the thickness of blade 106. The opening has a second portion 156*a* disposed parallel to the planes of the receptacle top and bottom and therefore perpendicular to the portion 154*a*. The length and width of portion 156*a* are the same as that of portion 154*a*. The two portions 154*a*, 156*a* define an opening of cross-like or cruciform shape. Similarly, for blade portion 118 of pin 30*b*, the opening in wall 90 has a first portion 154*b* and a second portion 156*b* disposed at substantially right angles. The lengths and widths of the portions 154*b*,156*b* bear the same relationships to the width and thickness of blade portion 118 as portions 154*a*,156*a* bear to blade 106. Likewise, for blade portions 130 of pin 30*c* the opening in wall 90 has a first portion 154*c* and a second portion 156*c* disposed at a right angle thereto. The length and widths of the portions 154*c*,156*c* bear the same relationships to the width and thickness of blade 130 as the foregoing opening portions bear to the foregoing blades.

In the connector shown, the blades 106,118 and 130 are received in the portions 154*a*,154*b* and 154*c* of the corresponding openings in wall 90. However, any or all of the blades during manufacture of the connector could be positioned in the portions 156*a*,156*b* and 156*c* of the openings to provide the selected different orientations of the pins according to selected voltage magnitude and phase conditions for the connector as previously described. The provision of the openings with the two angularly disposed portions thus facilitates convenience and ease in manufacture of the connector.

The connector according to the present invention further comprises retainer means in the receptacle body operatively engaging the pin portions within the body for preventing the pins from being forced further into the body. The purpose of the retainer means is to prevent inward jamming of a pin such as during an attempt to connect the receptacle with a non-mating plug or simply by the jamming force of a tool or other object. The tabs associated with each of the inner portions extend at a right angle to the longitudinal axis of the pin blade portions. Thus, any force applied to the pin blade portions in a direction generally longitudinally thereof will be applied substantially normal to the surface of the tab portions. There is provided a retainer element for each of the outermost pins 26,30*c* which extends inwardly from one of the body walls and is closely adjacent the tab portion for engaging the same in the event of any forced inward movement of the pins. In particular, as shown in FIG. 5, a first formation 170 extends inwardly from the inner surface of the top side wall 74 adjacent the elongated body 98. Formation 170 is elongated, solid rectangular in shape, extends along a major portion of the length of the body 98 and terminates in an end surface 72 closely adjacent the tab 96. Accordingly, a force acting on the blade 94 generally longitudinally thereof tending to force it inwardly through wall 90 will be countered and stopped by the surface 172 engaging the tab 96. Similarly, a second formation 174 extends inwardly from the inner surface of the top side wall 74 in proximity to the elongated body 134. Formation 174 is elongated, solid rectangular in shape and extends along a major portion of the length of body 134. Formation 174 has an end surface 176 closely adjacent the tab 132. Therefore, a force acting on blade 130 longitudinally thereof tending to force it inwardly through wall 90 would be countered and stopped by engagement between surface 176 and tab 132.

The retainer means for the remaining pins comprises a post like formation 180 which extends from the other side wall portion, i.e the bottom as viewed in FIG. 5. Post 180 is formed integrally with the receptacle body and includes a pair of surfaces 182, 184 disposed toward the tabs 108 and 120 in closely spaced relation thereto. Thus, any force acting on blades 106,118 generally longitudinally thereof would be countered and stopped by engagement between surfaces 182,184 and the corresponding tabs. Post 180 is provided with a through bore or passage 190 to accommodate a mounting bolt 192 or screw for attachment of receptacle 14 to the body of the machine 12. Another post 194 extends from bottom side wall 76 and is located adjacent the other end 84. It likewise is provided with a through bore or passage 196 for accommodating a second mounting bolt 198 or screw. The posts 180,194 are located on opposite sides of the opening 142.

The posts 180,194 are of electrically insulative material, are integral with the body, and therefore serve as insulating barriers betwen the adjacent pin portions. Thus, post 194 serves as an insulating barrier between the terminal formations 100 and 136 and the associated electrical terminal structures. Similarly, post 180 serves as an electrical insulating barrier between the inner portions of the pins **30*a* and 30*b* located within the wall 90. To this end, post 180 also is provided with a wall-like formation 202 which terminates adjacent the wall 90 and meets the two surfaces 182,184 of the post 180. There is provided a wall 204 extending from the receptacle bottom adjacent body portion 98 also serving as an insulating barrier. Wall 204 is elongated and relatively thin and extends from the vicinity of terminal formation 100 along body portion 98 and between the body 98 and the terminal formation 112 of the adjacent pin whereupon it terminates in a leg formation 206 having right angle sections and extending through the space between tabs 96 and 108 and terminating adjacent the wall 90. In a similar manner, a wall 208 formed integrally with the receptacle bottom extends along body portion 134 from terminal formation 136 and between the body 134 and the terminal formation 124 of the adjacent pin whereupon it terminates in a leg formation 210 having right angle sections and extending between tabs 132 and 120 and terminating adjacent wall 90. Thus, posts 180 and 194, the central wall 202 of post 180 and the walls 204, 208 serve as electrically insulating barriers between the adjacent pin portions for increased safety in operation. The top wall portion has extending or raised surface formations in registry with the terminals, in particular with registry with the terminal screws 102, 114, 126 and 138. These formations are disposed closely adjacent the screws when the parts are fitted together thereby serving to prevent loosening of the screws and thereby maintaining the connection of the leads on the terminals for purposes of added safety. The formations also provide an increased amount of insulative material adjacent the terminals. Thus, as illustrated in FIG. 7 formations 216 and 218 projecting from the inner surface of top side wall 74 are closely adjacent screws 126 and 138, respectively. Similarly, as illustrated in FIG. 8, formation 220 projecting from the inner surface of top side wall 74 is closely adjacent screw 102. Another formation (not shown) is closely adjacent screw 114**.

Plug 16 is a hollow body comprising a first portion which includes the extension 22 and a second portion which in the device shown is disposed at about a right angle to the first portion. As shown in FIGS. 5 and 7 extension 22 has an end wall 224, top side wall 226 and bottom side wall 228, as viewed in the drawings, which are in spaced generally parallel relation, and a pair of sides 230,232 substantially perpendicular to the top and bottom walls. The extension 22 joins the second body portion of the plug at the end of the extension opposite end wall 224. The slots 28 and **32*a*,32*b*,32*c* are provided in end wall 224. The first and second body portions of the plug 16 are of electrically insulative material, preferably plastic, and as previously described slot 28 is formed during molding of the plug body. Slots 32** then are formed subsequently, such as by stamping to provide the selected number and relative orientations of the slots depending upon the particular voltage and phase magnitudes for the particular connector being manufactured.

The extension 22 comprises a hollow body and a plurality of contacts are provided in the extension 22, one for each of the slots 28,32 and extending inwardly from the end wall 224 and associated slots. Each of the contacts of plug 16 comprises a pair of spaced-apart conductive blades adapted to enage a corresponding one of the pins of receptacle 14 when inserted in the slots and a central portion joining the blades and located in spaced relation to end wall 224. In particular as shown in FIG. 5, contact 234 is associated with slot 28 and has a pair of spaced-apart blades 236,238 which are open at the end adajcent slot 28 and which are joined at the opposite end by a central portion 240 which extends into the second body portion of plug 16 in a manner which will be described. Blades 236,238 are guided and held within the interior of extension 22 by a hollow rectangular guide housing 242 of plastic material having spaced apart side walls and an end provided with a slot 244 which is aligned with the slot 28. The inner surfaces of the guide housing side walls are tapered and shaped as shown to conform to the outer shape of the blades 236,238. Similarly, contact 248 associated with slot **32*a* has a pair of spaced apart blades 250,252 open at the end adjacent slot 32*a* and joined at the opposite end by central portion 254 which extends in the second body portion of plug 16. Blades 250,252 are received within a guide housing 256 having a slot 258 in the end thereof aligned with slot 32*a* and having the inner surfaces of the side wall shaped to conform to the blades 250,252. Additionally, a contact 262 is associated with slot 32*b*** and has spaced apart blades 264,266 open at the end adjacent slot 32*b* and joined at the opposite end by a central portion 268 which extends into the second body portion of plug 16. The blades are received in housing 270 having a slot 272 at the end aligned with slot 32*b* and having side wall inner surfaces shaped to conform to the blades 264,266. Finally, a contact 274 is associated with slot 32*c* and has spaced apart blades 276,278 open at the end adjacent slot 32*c* and joined by a central portion 280 extending into the plug second portion. The blades 276,278 are received in a housing 282 having a slot 284 aligned with slot 32*c* and having inner wall surfaces shaped to conform to the blades.

The second body portion of plug 16 comprises two parts joined together by a fastener such as screw 290 shown in FIG. 6, which parts define therebetween an interior region. Extension 22 is integral with one of the parts which includes sides 292,294 shown in FIG. 5 and a body portion designated 296 in FIGS. 6 and 7. The other part has a main side wall 300, sides 302,304 extending at right angles to wall 300, and ends 306,308 joining the sides and also extending at right angles to wall 300. The second part fits onto or receives the body of the first part as shown in FIGS. 5, 6 and 7.

Each of the central portions 240, 254, 268 and 280 of the contacts 234,248, 262 and 274, respectively, extends into the second body portion of plug 16 and along a surface of the body 296 and terminates in a terminal formation within the second body portion for connection to an electrical lead of supply conductor 18. For example, as shown in FIG. 7, the central portion 268 of contact 262 extends along the surface of body 296 and terminates in a terminal formation designated 310 having associated therewith a screw 312 and terminal washer 314 for making electrical connection to a lead of conductor 18 extending into the plug 16. An identical arrangement of terminal formation, screw and terminal washer is provided for each of the other contacts 234,248, 262 and 274.

In accordance with this invention there is provided stop means in the body of plug 16 operatively contacting the contacts therein for preventing the contacts from being forced into the body when the pins of receptacle 14 are inserted in the slots of plug 16. The stop means comprises a plurality of formations, one for each of the contacts in plug 16, integral with the plug body and located in positions for engaging the central portions of the contacts. As shown in FIGS. 5 and 7, there is provided a plurality of formations 318, 320, 322 and 324 integral with and extending from the main side wall 300 of the other part of the plug body. The formations are arranged in a row in spaced-apart generally parallel relation. Each of the formations is substantially solid rectangular in shape terminating in a flat edge for contacting the central portions of the blades. In particular, as shown in FIG. 5, formation 318 has an edge 326 contacting central portion 240 of contacts 234. Formation 320 has an edge 328 contacting central portion 254 of contact 248. Similarly, formation 322 has an edge 330 contacting central portion 268 of contact 262. Finally, formation 324 has an edge 332 contacting central portion 280 of contact 274. Thus, when the parts of the plug 16 are assembled together, the firm contact between the formations 318,320, 322 and 324 and the corresponding central portions of the respective contacts prevents the contacts from being forced inwardly into plug 16 out of position in response to insertion of the pins or any other object.

The contacts in plug 16 are arranged in spaced relation along each row and the plug is provided with barrier means of insulative material between adjacent ones of the contacts. The blades of the adjacent contacts are separated by the afore-mentioned guide housings which being of plastic material provide electrical insulation between adjacent contacts. The remaining portions of the blades and portions of the central parts are separated by regions of plastic in the body. In addition, a series of spaced apart walls 336,338 and 340 provide additional separation between the blade central portions. Also, each of the terminals has associated therewith an extending or raised portion of the inner surface of the main wall 300 for increasing the quantity of insulative material adjacent the terminal and for preventing loosening of the associated screw. For example, as shown in FIG. 7, there is a raised portion 344 adjacent screw 122.

The end of supply conductor 18 adjacent plug 16 is provided with a sheath or cover 350 which is slightly conical in shape and terminates in an annular lip 352 which fits into an annular groove 354 in body 296 and wall 300. Conductor 18 extends further into the interior of plug 16 and is anchored between a semicircular surface, a portion of which is designated 356 in FIGS. 6 and 7, and a clamp including a bar or strip 358 and a screw fastener 360. Proper relative orientation between recess 20 and extension 22 when receptacle 14 and plug 16 are connected together is guided by a co-operation between a groove-like recess 362 in the surface of extension 22 and a mating formation 364 in the surface of recess 20 which slides along groove 362 as extension 22 is moved into recess 20.

FIG. 12 shows in further detail one of the contact elements of plug 16, for example contact 234. The blades 236,238 are joined by central portion 240 which extends into a strip-like body terminating in a terminal formation 368 provided with an aperture 370 to receive the associated terminal screw. Contact 234 has blades 231,238 positioned for co-operation with the corresponding slot in the recess end wall which is disposed in one orientation, i.e. vertically as viewed in FIGS. 3 and 4. As previously described, some of the slots will be disposed in another orientation, i.e. at a right angle to the first orientation, as determined by the selected voltage and phase magnitudes of the particular connector. According, FIG. 13 shows a contact 374 for co-operation with a slot in the end wall 224 of extension 22 which is disposed in the other orientation, i.e. horizontally as viewed in FIGS. 3 and 4. Contact 374 has a pair of spaced apart blades joined by a central portion 380 which is located at the one side of the blade combination. An elongated strip-like body extends from one blade, i.e. blade 376, and terminates in a terminal formation 384 provided with an aperture 386 for an associated terminal screw. When contacts of the type similar to contact 374 are provided in extension 22, an associated guide housing also is provided, similar to those shown in FIG. 5, but displaced ninety degrees about the guide housing longitudinal axis so that the shaped inner surfaces co-operate with the surfaces of blades 376,378.

In the forming plug 16, the portion including extension 22, being preferably of plastic material, is molded in a typical manner. During such molding, slot 26 is formed in recess end wall 224 as part of the molding operation and the remainder of wall 224 is solid upon completion of the molding operation. The remaining slots 32 are formed during a subsequent step, preferably by stamping which provides a particular number and orientations of slots for that particular connector. The previously molded portions of plug 16 would be held in a suitable fixture, and a die with slot forming projections of the specified number and orientations would be pressed into end wall 224 to stamp out the remaining slots 32.

FIG. 14 further illustrates the manner in which the additional pins 30 and additional slots 32 of the connector are selected to accommodate various voltages and phases while at the same time preventing a part of a connector designed for a particular voltage and/or phase from physically or mechanically being connected to a part of another connector designed for a different voltage and/or phase. For convenience in illustration, only the plug components of the connector are shown in FIG. 14. By way of example, plug 400 is for 42 volts, plug 402 for 110 volts, plug 404 for 220 volts and single phase, plug 406 for 220 volts and three phase, and plug 408 for 380 volts and three phase. Plug 408, for example, is non-interchangeable with any of the plugs 410, 412, 414 , 416 and 418, i.e. it would not mate with the receptacles corresponding to these plugs. Similarly, any of the plugs 400,402,404 and 406 is non-interchangeable with any of the plugs 410, 412, 414, 416 and 418. Also, any of the plugs 400, 402, 404, 406 and 408 in the group in the left-hand column in FIG. 14 is non-interchangeable, i.e. will not mate with the corresponding receptacle, with any of the other plugs in that same group. By way of further illustration, in the particular arrangement shown in FIG. 14, plug 416 will mate with receptacles for plugs 410, 412 and 414 but the inverse or reciprocal of that relationship is not true. Accordingly, for an absolutely non-interchangeable relationship between the plugs in the two columns shown in FIG. 14, the plugs 400, 402, 404, 406 and 408 in the left-hand column should be related to either the group of plugs 410, 412 and 414 in the right-hand column or the single plug 416.

It is therefore apparent that the present invention accomplishes its intended objects. While an embodiment of the present invention has been described in detail, this is done for the purpose of illustration, not limitation.

We claim:

1. An electrical connector for supplying electrical power to a machine at particular voltage and phase magnitudes selected, said connector having one part adapted to be mechanically and electrically connected to the machine and another part adapted to be electrically connected to a conductor providing the electrical power to be supplied, said connector comprising:

(a) a plurality of pins on a first one of said connector parts and a corresponding plurality of mating slots on a second one of said connector parts adapted to receive said pins when said connector parts are connected together;

(b) one of said pins and a corresponding one of said mating slots serving as means for completing an electrical ground circuit and having a fixed orientation independent of the selected voltage and phase magnitude for the particular connector;

(c) the total number and respective orientations of the remaining ones of said pins and slots determined by the particular voltage and phase magnitude selected for the connector, said total number of orientations of said remaining pins and slots being fixed and non-changeable in the connector;

(d) said total number and orientations of said remaining ones of said pins and slots also being predetermined to prevent connection between either of said connector parts and a part of another connector of the same type as said connector but operative with different selected voltage and phase magnitudes;

(e) said first part having said pins comprising a first hollow body having a first end wall, said first end wall provided with openings through which pins extend, each of said pins having a portion extending inward into said body and a portion extending outward from said body, each of said opening in said first end wall being of a size and a shape to accommodate different selected orientations of said remaining pins, said outward extending portion of each of said remaining pins being flat and blade-like and each of said remaining pin openings in said first end wall having a first portion having a shape and size to receive said outward extending pin portion and a second portion disposed at an angle to said first portion and having a shape and size to receive said outward extending pin portion;

(f) each of said pins is comprised of two separate parts, one pin part including said outwardly extending portion and the other pin part including said inwardly extending portion, one of said pin parts having on one end thereof a tab provided with an opening therein and the other of said pin parts having on one end an extension of a cross-sectional shape and size to be received in said tab opening, said pin parts being permanently secured together with said extension fitted into said tab opening, the cross sectional shape of said tab opening and said extension accommodating two different relative orientations of said pin parts; and (g) said second part having said slots comprising a second hollow body having a second end wall containing said slots, a plurality of contacts in said second body, one for each slot and extending inwardly from said second end wall and the associated slot, said contacts being arranged in spaced relation along a row, each of said contacts comprising a pair of spaced-apart conductive blades adapted to engage said pins when inserted in said slots and a central portion joining said blades and located in spaced relation to said end wall and means in said second body defining a corresponding plurality of guide housings of electrically insulative material for receiving corresponding pairs of said blades, said guide housings having inner surfaces shaped to accommodate said blades in two different relative orientations corresponding to said two different relative orientations of said pin parts.

2. A connector according to claim 1, wherein the outwardly extending portions of said pins are arranged along a row in said first connector part, said slots are arranged along a row in said second connector part, said outwardly extending portion of one pin and mating slot are disposed in a first plane, and said remaining outwardly extending portions of said pins and mating slots are disposed in planes parallel to or perpendicular to said first plane as determined by a relationship to the particular voltage and phase magnitude selected for that connector.

3. A connector according to claim 2, wherein said first plane is perpendicular to said row.

4. A connector according to claim 1, wherein each of said connector parts has a respective end portion, the end portion of one of said parts being formed to include a recess and the end portion of the other of said parts being formed to include an extension shaped and sized to fit snugly mechanically within said recess of said one part when said connector parts are connected together.

5. A connector according to claim 4, wherein said pins are on said first part having said recess and said slots are in said second part having said extension.

6. A connector according to claims 1 or 5, wherein said first part having said pins is adapted for connection to said machine and said second part having said slots is adapted for connection to said supply conductor.

7. A connector according to claim 1, further including manually operated mechanical connecting means operatively associated with said connector parts for providing a mechanical connection and disconnection between said parts in response to manual operation thereof.

8. A connector according to claim 7, wherein said manually operated connecting means comprises a first member movably connected to one of said connector parts and having an engagement means thereon, a second member fixed to the other of said connector parts and having a formation thereon adapted to be contacted by said engagement means on said first member, said first and second members being manually movable with respect to each other between positions of engagement and disengagement.

9. A connector according to claim 8, further including biasing means for urging said first member into a position of engagement.

10. A connector according to claim 1, wherein each of said first end wall openings has a cross-like shape.

11. A connector according to claim 1, wherein the outwardly extending portion of said one of said pins providing the electrical ground is longer than the outwardly extending portions of said remaining portions so that the electrical ground connection is made first when said parts of said connector are connected together.

12. A connector according to claim 1, wherein said first part having said pins further includes retainer means in said first body for preventing said pins from being forced further into said body.

13. A connector according to claim 12, wherein said first body is generally rectangular in.shape having a pair of spaced-apart generally parallel walls, said pin portions within said first body being arranged in a row generally parallel to said walls, the two outer-most pins having a surface portion disposed generally perpendicular to said row, and wherein said retainer means comprises a retainer element for each of said outer-most pins extending inwardly from one of said body walls and engaging said surface portion of the corresponding one of said outer pins.

14. A connector according to claim 12, wherein said first body is generally rectangular in shape having a pair of spaced-apart generally parallel walls, said pin portions within said body being arranged in a row generally parallel to said walls, the inner pins in the row having a surface portion disposed generally perpendicular to said row, and wherein said retainer means comprises a formation extending inwardly from one of said body walls and engaging said surface portion of the corresponding one of said inner pins.

15. A connector according to claim 14, wherein said formation is provided with a through bore for receiving a fastener for mounting said connector part on a machine.

16. A connector according to claim 14, wherein said body is of insulative material and said formation serves as a separating and insulating barrier between adjacent pin portions in said row.

17. A connector according to claim 1, wherein each of said pin portions extending into said first body cooperates with structure within said first body and has a configuration different from that of the other pin portions extending into said first body to prevent said pins from being interchanged by the user.

18. A connector according to claim 17, wherein said first body includes a second, opposite end wall spaced from said first endwall, and wherein said pin portions extending into said first body are arranged in a row with the two outermost pin portions extending between said first and second end walls and terminating adjacent said second opposite end wall each in a terminal for making electrical connection thereto.

19. A connector according to claim 18, wherein the remaining ones of said pin portions extending into said first body terminate adjacent said first end wall each in a terminal for making electrical connection thereto.

20. A connector according to claim 19, wherein said first body includes a pair of side walls joining said end walls, said remaining pin portions extending into said first body are arranged generally parallel to said side walls, and an opening in one of said side walls generally centrally thereof for receiving an electrical conductor for connection to said terminals.

21. A connector according to claim 1, wherein said first body of said first part having said pins is of insulative material having a pair of side walls in spaced, generally parallel relation, said inwardly extending pin portions being arranged in spaced relation parallel to said side walls, and a plurality of formations extending inwardly from at least one of said side walls and extending between adjacent ones of said inwardly extending pin portions to serve as insulating barriers therebetween.

22. A connector according to claim 1, wherein said first body of said first part having said pins is of insulative material having a pair of side walls in spaced-apart relation, each of said pin portions extending into said body terminating in a terminal structure, and wherein the inner surface of at least one of said side walls has raised formations in registry with said terminals for operative contact therewith.

23. A connector according to claim 1, wherein one of said slots contained in said second end wall of said second body is molded in said second end wall during forming of said second body and said remaining slots subsequently being stamped in said second end wall.

24. A connector according to claim 1, further including stop means in said second body operatively contacting said contacts for preventing said contacts from being forced into said second body when said pins are inserted in said slots.

25. A connector according to claim 24, wherein said stop means comprises a plurality of formations, one for each of said contacts, integral with said second body and located in positions for engaging said central portions of said contacts.

26. A connector according to claim 24, wherein said second body has first and second portions extending at about a right angle to each other, said first portion having said end wall containing said slots, said blades of said contacts being located in said first body portion, said central portions of said contacts being located in said second body portion, each of said central portions having an extension terminating in a terminal for connection to an electrical conductor, and said stop means being located in said second body portion.

27. A connector according to claim 26, wherein said stop means comprises a plurality of formations, one for each of said contacts, integral with said second portion of said second body and located in positions for engaging said central portions of said contacts.

28. A connector according to claim 1, wherein said contacts are arranged in spaced relation along a row, and further including barrier means of insulative material between adjacent ones of said contacts.

29. A connector according to claim 28, wherein said second body is of insulative material and said barrier means comprises a plurality of formations integral with said second body and extending into positions between adjacent ones of said contacts.

30. A connector according to claim 1, wherein said second body comprises a pair of spaced-apart generally parallel side walls, said contacts have portions extending generally parallel to said side walls and terminating in electrical terminals and further including a formation on one of said side walls located to be in registry with each said terminals.

* * * * *